United States Patent [19]

Ohno et al.

[11] 4,196,577

[45] Apr. 8, 1980

[54] ELECTRONIC TIMEPIECE

[75] Inventors: Hideshi Ohno, Sayama; Tadamichi Mouri, Houya; Kazuo Teramoto, Fuchu; Kazunari Kume, Tokorozawa; Takatoshi Osaka, Higashikurume; Minoru Watanabe, Tokorozawa, all of Japan

[73] Assignee: Citizen Watch Co., Ltd., Tokyo, Japan

[21] Appl. No.: 862,540

[22] Filed: Dec. 20, 1977

[30] Foreign Application Priority Data

Dec. 27, 1976 [JP] Japan ..... 51/157791
Feb. 9, 1977 [JP] Japan ..... 52/13337

[51] Int. Cl.[2] ..... G04C 3/00; G04B 19/30

[52] U.S. Cl. ..... 368/82; 368/88; 368/294

[58] Field of Search ..... 58/23 R, 23 BA, 50 R, 58/52 R, 53, 88 R; 350/160 R, 160 CC; 361/397, 398, 399, 400

[56] References Cited

U.S. PATENT DOCUMENTS

| | | | |
|---|---|---|---|
| 3,863,436 | 2/1975 | Schwarzschild et al. | 58/50 R |
| 3,905,666 | 9/1975 | Grimm et al. | 58/23 R X |
| 3,973,388 | 8/1976 | Yoshida et al. | 58/50 R |
| 3,983,689 | 10/1976 | Burke et al. | 58/50 R |
| 4,042,861 | 8/1977 | Yasuda et al. | 361/400 |
| 4,045,953 | 9/1977 | Miyazaki | 58/23 R |
| 4,064,689 | 12/1977 | Yasuda et al. | 58/50 R |
| 4,070,821 | 1/1978 | Somogyi | 58/23 BA |
| 4,086,752 | 5/1978 | Kishimoto | 58/23 R |

*Primary Examiner*—Vit W. Miska
*Attorney, Agent, or Firm*—Sherman and Shalloway

[57] ABSTRACT

An extremely thin digital electronic timepiece comprising an electrooptical display element is disclosed. The timepiece essentially consists of a connector frame, supporting plate, flexible film-shaped circuit substrate and base plate. These constitutional members are manufactured in mass production scale by injection molding process, press working process etc. The circuit substrate is sandwiched between the supporting plate and the base plate. A portion of the connector frame is used to secure together the constitutional members into one integral body.

10 Claims, 10 Drawing Figures

ELECTRONIC TIMEPIECE

BACKGROUND OF THE INVENTION

1. Field of the Invention

This invention relates to electronic timepiece and more particularly to an extrememly thin digital electronic timepiece comprising an electrooptical display element composed of an electrochromic display element such as a liquid crystal element, etc.

2. Description of the Prior Art

Most of conventional electronic timepiece have adapted a module construction in which main constitutional members of the electronic timepiece, i.e., a display device, housing, circuit substrate and base plate are superimposed one upon the other and secured together by means of screws. Most of the circuit substrate may be formed of ceramics or glass mixed epoxy resin. On the circuit substrate are mounted a semi-conductor integrated circuit chip, time reference oscillator, condenser and any other electronic parts.

The housing and base plate are molded in thermoplastic resin such as polyacetal resin and polybutylene telephthalate resin. These constitutional members are superimposed one upon the other in the order such that the display device is located at the uppermost surface and then the housing, circuit substrate and base plate are located in the order as mentioned. That is, the circuit substrate is sandwiched between the housing and the base plate.

The conventional electronic timepiece constructed as above described has been encountered with the following drawbacks.

(1) The use of ceramics or glass mixed epoxy resin makes dimensions of the timepiece unstable and resistance to shocks low and is particularly unsuitable for making the timepiece thin in thickness.

(2) The circuit substrate formed of glass mixed epoxy resin is of a single body or sheet-shaped one so that it is difficult to manufacture it by a continuous automatic process.

(3) The housing and base plate are formed of synthetic resin and hence can easily be molded, but is poor in strength. As a result, in order to guarantee a resistance to shock it is necessary to make these members considerably thick in thickness.

(4) Since the housing, circuit substrate and base plate are not satisfactorily high in strength, it is difficult to provide a timepiece module having a high regidity by a combination of these members and to make it thin in thickness.

As a result, it is eagerly desired to provide an electronic timepiece which is so constructed as to eliminate the above mentioned drawbacks which have been encountered with the prior art techniques.

SUMMARY OF THE INVENTION

A principal object of the invention, therefore, is to provide a digital electronic timepiece which can eliminate the above mentioned drawbacks.

Another object of the invention is to provide an electronic timepiece which is thin in thickness and small in size.

A further object of the invention is to provide an electronic timepiece which is simple in construction and which can automatically be assembled and manufactured in an easy manner.

These and any other objects of the invention are attained by an electronic timepiece having the following construction, i.e., in an electronic timepiece comprising an electronic circuit composed of a time reference oscillator, integrated circuit chip, condenser, etc., a switch mechanism for operating said electronic circuit, a battery for constituting a power source for driving said electronic circuit and an electrooptical display element, a construction comprising a flexible film-shaped circuit substrate for mounting substantially all of said electronic parts thereon, a supporting plate for covering substantially all regions of said flexible film-shaped circuit substrate and a base plate provided therein with a battery reception depression, said flexible film-shaped circuit substrate being firmly sandwiched between said supporting plate and said base plate.

DETAILED DESCRIPTION OF PREFERRED EMBODIMENTS

Figure 1:
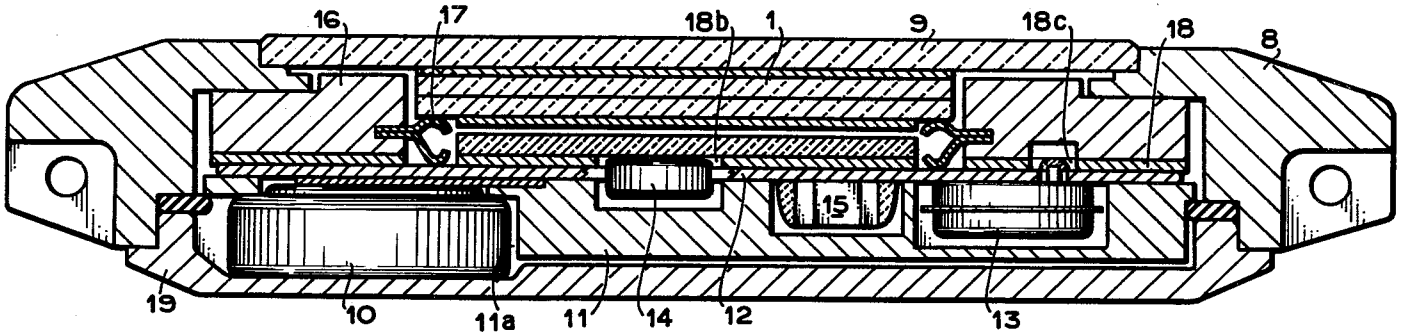
FIG. 1 is a longitudinal sectional view of one embodiment of an electronic timepiece according to the invention.
Figure 2:
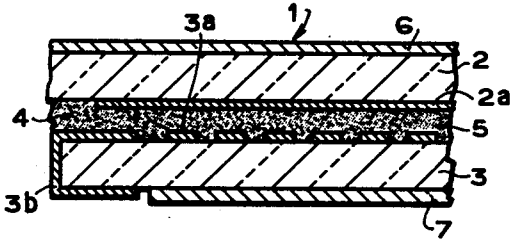
FIG. 2 is a partial longitudinal sectional view showing a liquid crystal display element shown in FIG. 1 in an enlarged scale.

Various embodiments of the invention will now be described in greater detail with reference to the accompanying drawings. In FIG. 1 is shown a first embodiment of an electronic timepiece according to the invention showing the electronic timepiece as a whole in section. Reference numeral 1 designates an electrooptical display element which will be described with reference to an example composed of a twisted nematic type liquid crystal display element (abbreviated as a liquid crystal display element). In FIG. 2 is shown a detailed construction of the liquid crystal display element composed of upper and lower transparent substrates 2 and 3. The upper transparent substrate 2 is provided thereon with a transparent common electrode 2*a* formed of indium oxide ($In_2O_3$) and the lower transparent substrate 3 is provided thereon with transparent segment electrodes 3*a*, these common and segment electrodes being formed by vapor deposition and photoetching techniques. The lower transparent substrate 3 is provided with an outside connection electrode 3*b* formed of chrome-gold alloy (Cr—Au alloy) and vapor deposited through a mask on upper side, end and lower side surfaces of the lower transparent substrate 3. Reference numeral 4 designates a sealing member made integral with a spacer for suitably spacing apart the upper and lower transparent substrates 2, 3 and formed, for example, of glass having a low melting point. Reference numeral 5 designates a liquid crystal substance and 6, 7 polarization plates, respectively. These polarization plates 6, 7 are cut such that respective directions of polarization cross perpendicular with each other and bonded with the transparent substrates 2, 3 and made integral therewith, respectively.

Referring now to FIG. 1, reference numeral 8 designates a timepiece case, 9 a cover glass, and 19 a back cover. The liquid crystal display element 1 is bonded with the cover glass 9 and made integral therewith. The cover glass 9 is mounted on the timepiece case 8 by bonding, etc. Reference numeral 10 designates a battery enclosed in a depression 11*a* provided in a base plate 11 and 12 a flexible film-shaped circuit substrate on which are mounted a time reference oscillator 13, a semiconductor integrated circuit chip 14 including various circuits such as an excitation circuit for the time reference oscillator 13, frequency divider circuit, display circuit, etc. and electronic parts such as a condenser 15, etc.

The liquid crystal display element 1 is electrically connected to the flexible film-shaped circuit substrate 12 by means of a spring connector terminal 17 formed of metal and made integral with a connector frame 16. Reference numeral 18 designates a supporting plate superimposed on substantially all region of the flexible film-shaped circuit substrate 12 and provided with a return spring portion 18*a* (FIG. 3B) which serves also as a contact for a switch mechanism and with an escape window 18*b* for enclosing the semiconductor integrated circuit chip 14 and an escape window 18*c* for enclosing the time reference oscillator 13. The supporting plate 18 is electrically connected at its anode side to ground.

Mutual position among the supporting plate 18, flexible film-shaped circuit substrate 12 and base plate 11 is so related that the flexible film-shaped circuit substrate 12 is firmly sandwiched between the supporting plate 18 and the base plate 11. Reference numeral 19 designates a back cover of the timepiece case.

Figure 3B:
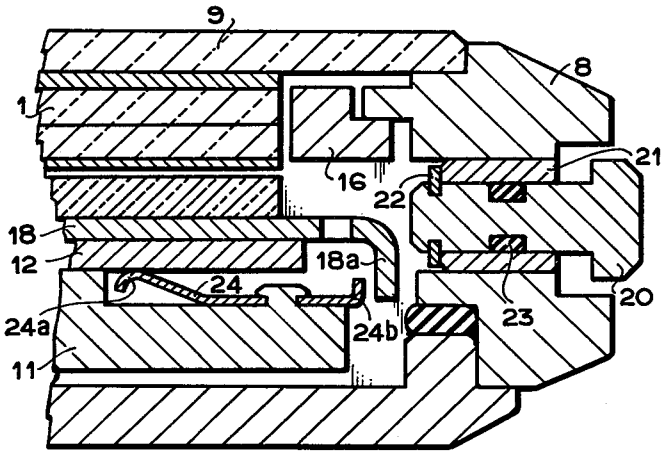
FIG. 3B is a partial longitudinal sectional view showing those constitutional members shown in FIG. 1 which are arranged around a switch mechanism shown in FIG. 1 in an enlarged scale.
Figure 3A:
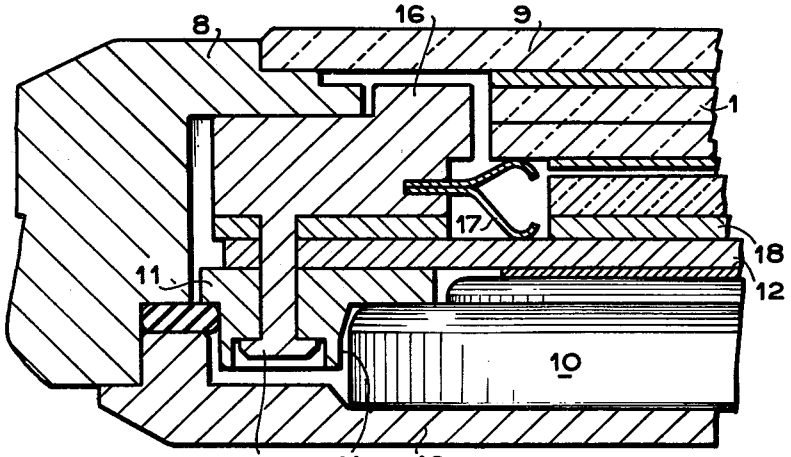
FIG. 3A is a partial longitudinal sectional view showing those constitutional members shown in FIG. 1 which are secured together into one integral body in an enlarged scale.

In FIG. 3A are partly shown in section those constitutional members shown in FIG. 1 which are secured together into one integral body. As shown in FIG. 3A, the connector frame 16, supporting plate 18, flexible film-shaped circuit substrate 12 and base plate 11 are secured together into one integral body by means of a projection 16*a* projected from the connector frame 16.

In FIG. 3B are shown those constitutional members shown in FIG. 1 which are arranged around a switch mechanism for operating an electronic circuit. In FIG. 3B, reference numeral 20 designates a switch button, 21 a pipe secured to the timepiece case 8, 22 an E-ring which functions to mount the switch button 20 on the timepiece case 8.

Reference numeral 23 designates an O-ring mounted on the switch button 20 and for preventing water, etc. from penetrating through a gap formed between the switch button 20 and the pipe 21. Reference numeral 24 designates a contact spring secured to the base plate 11 and having one end 24*a* urged against the flexible film-shaped circuit substrate 12 and the other end 24*b* adapted to be made in contact with the return spring 18*a* formed at the end of the supporting plate 18. As a result, if the switch button 20 is pushed, the return spring 18*a* of the supporting plate 18 becomes contact with the contact spring 24 to energize the electronic circuit through the electrically conductive pattern on the flexible film-shaped circuit substrate 12, thereby permitting to effect display change-over operation, time correction operation, etc.

Figure 3C:
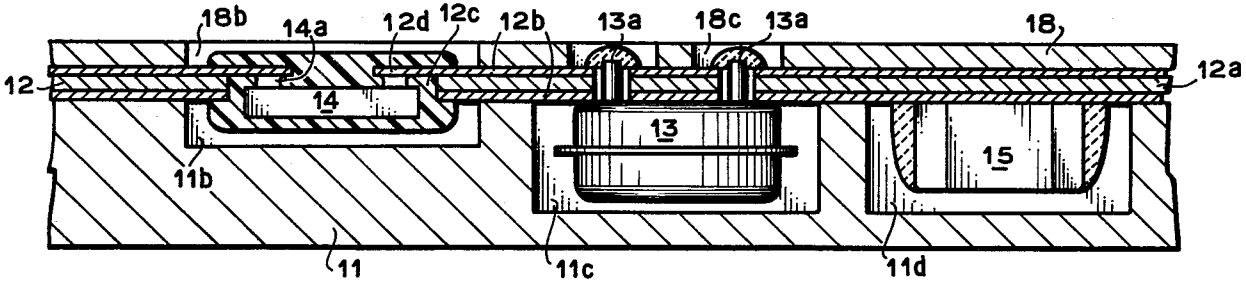
FIG. 3C is a partial longitudinal sectional view showing those constitutional members shown in FIG. 1 which are mounted on a flexible film-shaped circuit substrate shown in FIG. 1 in an enlarged scale.

In FIG. 3C are shown in section those constitutional members shown in FIG. 1 which are mounted on the flexible film-shaped circuit substrate 12. The flexible film-shaped circuit substrate 12 is composed of a flexible base film 12*a* formed of an electric insulation material and an electrically conductive foils 12*b* disposed on upper and lower surfaces of the base film 12*a*, respectively. The flexible film-shaped circuit substrate 12 is formed of an elongate tape and provided at that portion thereof to which is secured the semiconductor integrated circuit chip 14 with a window 12*c* into which is projected a finger 12*d* of the electrically conductive foil 12*b*. The semiconductor integrated circuit chip 14 is provided at its electrode pad portion with a bump 14*a* which is gang bonded with the finger 12*d* by a hot press bonding process.

The semiconductor integrated circuit chip 14 is coated with resin for the purpose of protecting the bonded portions and of improving resistance to environments.

The time reference oscillator 13 is provided with lead terminals 13*a*, 13*a* soldered to the electrically conductive foil 12*b* of the flexible film-shaped circuit substrate 12. As a result, the time reference oscillator 13 is electrically and mechanically connected to the flexible film-shaped circuit substrate 12. The step-up condenser 15 is also soldered to the electrically conductive foil 12*b* of the flexible film-shaped circuit substrate 12 and hence electrically and mechanically connected to the latter.

The base plate 11 is molded in thermoplastic resin such as polyacetal, juranecks, etc. and provided with the battery reception depression 11*a* and with the other depressions 11*b*, 11*c*, 11*d* for enclosing those electronic parts which are mounted on the flexible film-shaped circuit substrate 12. As a result, it is possible to make the base plate 11 relatively simple in construction.

Now turning again to FIG. 3A, all of four constitutional members, that is, the connector frame 16, supporting plate 18, flexible film-shaped circuit substrate 12 and base plate 11 are secured together into one integral body. Alternatively, among these four constitutional members at least two members may be selectively combined and secured together into one integral body. The first embodiment of the invention shown in FIGS. 1, 2 and 3 makes use of the former method of securing together the four members into one integral body by means of a hot caulking. That is, as shown in FIG. 3A, the projection 16*a* made integral with the connector frame 16 is extended through holes provided in the supporting plate 18, flexible film-shaped circuit substrate 12 and base plate 11, respectively, and the free end of the projection 16*a* is hot deformed under pressure so as to secure together these four members into one integral body. The connector frame 16 is provided with several projections 16*a* located at suitably selected positions. The method of securing together the above mentioned four members into one integral body is not limited to the above described hot caulking method, but use may also be made of any other methods such as an ultrasonic welding method, mechanical caulking method, etc.

Figure 4:
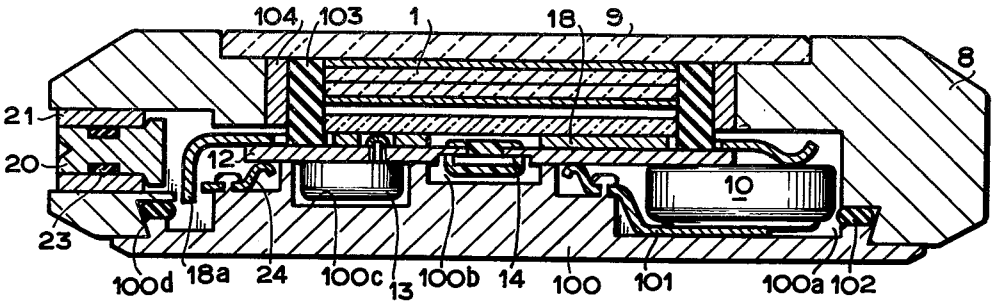
FIG. 4 is a longitudinal sectional view of a second embodiment of an electronic timepiece according to the invention showing a base plate used also as a back cover.
Figure 5:
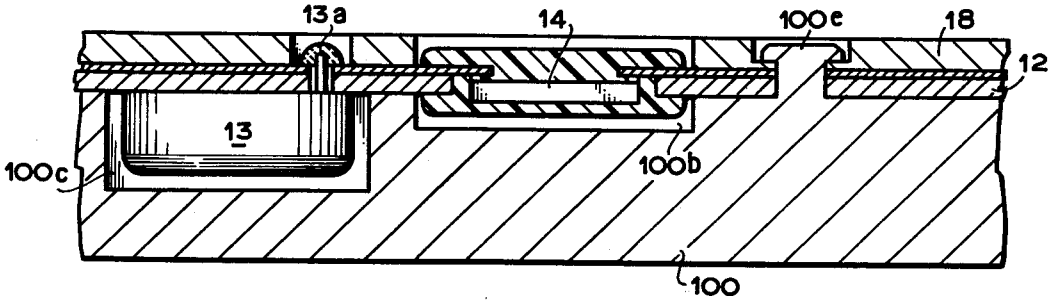
FIG. 5 is a longitudinal sectional view showing those constitutional members which are arranged around an electronic circuit shown in FIG. 4 in an enlarged scale.

In FIGS. 4 and 5 is shown a second embodiment of the invention. The present embodiment is characterized in that the side surface of the liquid crystal display element is electrically connected through the outside connection electrode and an electrically conductive member to the electronic circuit and that the base plate is used also as the back cover of the timepiece case. In FIGS. 4 and 5, those constitutional members which are the same in construction and ability as those shown in the first embodiment are designated by the same reference numerals.

Referring to FIGS. 4 and 5, reference numeral 100 designates a base plate used also as a back cover and formed of resin such as polyacetal or juranecks, added with or without glass fiber and aluminum powders. The base plate 100 is provided with a battery reception depression 100*a*, depressions 100*b* and 100*c* for enclosing an integrated circuit chip 14 and time reference oscillator 13 therein, respectively, and a fitting projection 100*d* adapted to be fitted to a timepiece case 8, etc., all of these depressions and projection being made integral with the base plate 100 by means of an injection molding method. The battery reception depression 100*a* is so shaped that a battery 10 is permitted to be detachably inserted thereinto from the side surface of the base plate 100. The base plate 100 is provided not only with the above mentioned depressions and projections, but also with a lead plate 101 for supplying an electric power from the battery 10 to the circuit substrate 12 and with a contact spring 24 for constituting a switch mechanism, the lead plate 101 and contact spring 24 being secured to the base plate 100 by a hot caulking method. Reference numeral 102 designates an O-ring which functions as a packing sandwiches between the base plate 100 and the timepiece case 8 and 103 a connection rubber composed of electrically conductive layers and insulation layers each alternatively superimposed one upon the other. The connection rubber 103 functions to electrically connect the outside connection electrode 3*b* (FIG. 2) of the liquid crystal display element 1 through the end surface thereof to the electrically conductive pattern on the flexible film-shaped circuit substrate 12. Two adjacent spaced apart electrically conductive layers of the connection rubber 103 may be separated from each other by a distance which is the same as or which is far shorter than the height of the outside connection electrode 3*b*. If the distance between the two adjacent spaced apart electrically conductive layers of the connection rubber 103 is made extremely short, the outside connection electrode 3*b* is connected through any electrically conductive layers to the electrically conductive pattern on the flexible film-shaped circuit substrate 12. Such connection is made free irrespective of a distance error involved between the two adjacent spaced apart electrically conductive layers of the connection rubber 103 and hence ensures a positive electrical connection between the outside connection electrode 3*b* and the electrically conductive pattern on the flexible film-shaped circuit substrate 12.

Reference numeral 104 designates an insulation spacer for determining the position of the connection rubber 103 and insulating the timepiece case 8 from the connection rubber 103. If the timepiece case 8 is formed of resin and provided with a portion for determining the position of the connection rubber 103, it is not necessary to use the insulation spacer 104.

In FIG. 5 are shown both the flexible film-shaped circuit substrate 12 including the semiconductor integrated circuit chip 14 and time reference oscillator 13 mounted on the substrate 12 and the metallic supporting plate 18 secured to and made integral with the base plate 100.

The base plate 100 is provided at its suitable positions with projections 100*e*. The flexible film-shaped circuit substrate 12 and the supporting plate 18 superimposed one upon the other on the base plate 100 are secured to and made integral with the base plate 100 by heating the free end of each of the projections 100*e* and deforming it under pressure.

As a result, the base plate 100 may also be used as the back cover. Thus, it is possible to reduce the number of constitutional members of the timepiece, thereby making the timepiece thin in thickness and small in size in an easy manner.

Figure 6:
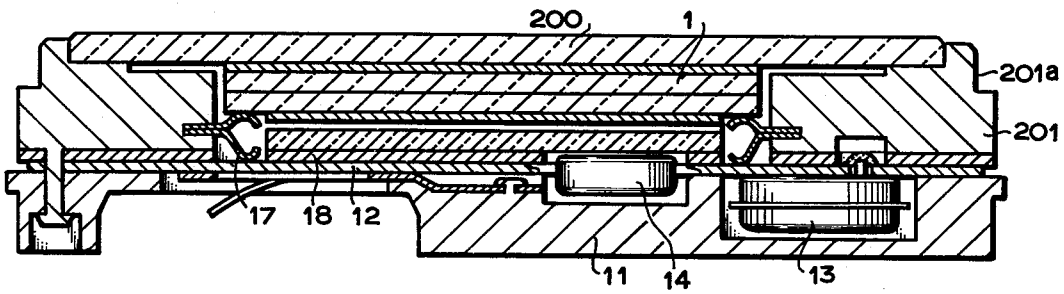
FIG. 6 is a longitudinal sectional view of a third embodiment of an electronic timepiece according to the invention showing a timepiece module mounted on a cover glass.
Figure 7:
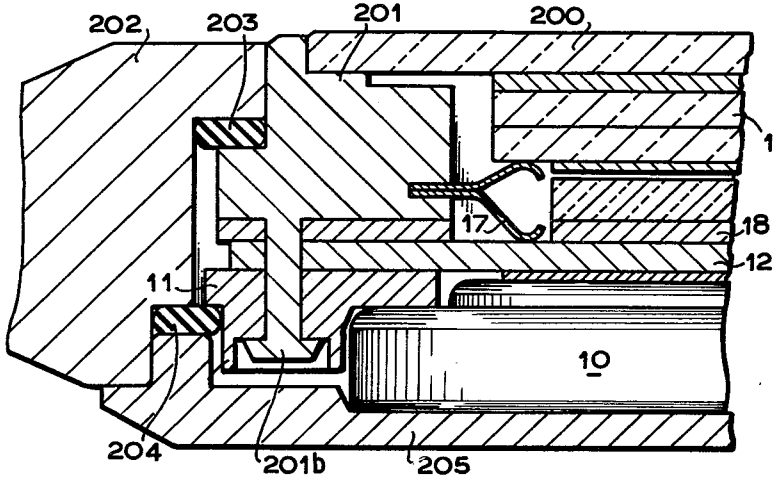
FIG. 7 is a partial longitudinal sectional view of the timepiece module shown in FIG. 6 and incorporated into a timepiece case in an enlarged scale.

In FIGS. 6 and 7 is shown a third embodiment of an electronic timepiece according to the invention. In the present embodiment, a cover glass made integral with a liquid crystal display element is secured to and made integral with a connector frame by means of bonding, etc. so as to provide a timepiece module which constitutes a unit body. Reference numeral 201 designates a connector frame formed of resin and provided with a metallic spring connector terminal 17 made integral with the connector frame 201 by molding and with an engaged member 201*a* adapted to be engaged with a timepiece case 202. Reference numeral 200 designates a cover glass made integral with the liquid crystal display element 1 and bonded with the connector frame 201. The other constitutional members are the same in construction and ability as those of the first embodiment shown in FIGS. 1 to 3 and designated by the same reference numerals. Reference numeral 203 designates a packing for preventing sweat, water, etc. from penetrating into the inside through a gap formed between engaged portions of the connector frame 201 and the timepiece case 202, 204 a packing for preventing sweat, water, etc. from penetrating into the inside through a gap formed between engaged portions of the timepiece case 202 and the back cover 205. The connector frame 201 is provided with a plurality of projection 201*b* each extending through the supporting plate 18, flexible film-shaped circuit substrate 12 and base plate 11 in the order as mentioned and the free end of each of the projections 201*b* is heated and then deformed under pressure so as to secure together the connector frame 201, spporting plate 18, flexible film-shaped circuit substrate 12 and base plate 11 into one integral body.

Figure 8:
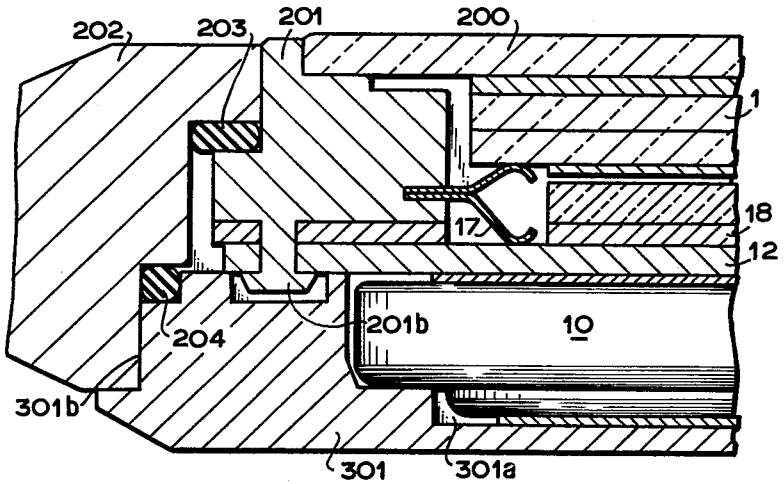
FIG. 8 is a partial longitudinal sectional view of a fourth embodiment of an electronic timepiece according to the invention showing a base plate of the timepiece module of the third embodiment shown in FIG. 7 used also as a back cover in an enlarged scale.

In FIG. 8 is shown a fourth embodiment of an electronic timepiece according to the invention. In the present embodiment, the base plate of the third embodiment shown in FIGS. 6 and 7 is used also as a back cover. Reference numeral 301 designates a base plate used also as a back cover. The base plate 301 is provided with a battery reception depression 301*a*, an engaged portion 301*b* adapted to be engaged with a timepiece case 202 and with any other electronic parts reception depression. On the base plate 301 are mounted a lead plate and contact spring. In the present embodiment, the connector frame 201 is provided with a projection 201*b* extending through the metallic supporting plate 18 and flexible film-shaped circuit substrate 12 so as to secure together the connector frame 201, supporting plate 18 and the circuit substrate 12 into one integral body.

The liquid crystal display element used in the above described embodiments may be replaced by another electrooptical display element such as an electrochromism display element.

As stated hereinbefore, the construction of an electronic timepiece according to the invention essentially consists of a connector frame, metallic supporting plate, flexible film-shaped circuit substrate and base plate and is characterized in that these constitutional members are selectively combined and secured together into one integral body. As a result, various constructions may be developed from a basic construction such as the first embodiment shown in FIGS. 1 to 3.

In addition, the connector frame, supporting plate and basic plate are simple in configuration, so that all of these constitutional members are manufactured in mass production scale by injection molding process, press working process, etc. in less expensive manner. The flexible film-shaped circuit substrate is of an elongate tape-shaped one, so that not only the semiconductor integrated circuit, but also any other electronic parts may be mounted thereon by a continuous treatment.

As seen from above, the electronic timepiece according to the invention is composed of constitutional members superimposed one upon the other and these constitutional members are simple in configuration and construction, so that it is possible to make the timepiece thin in thickness and small in size and to easily automate its manufacture and assembling.

What is claimed is:

1. An electronic timepiece comprising:

(a) an electronic circuit including at least electronic parts such as a time keeping oscillator, semiconductor integrated circuit chip and condensor;

(b) a switch mechanism for operating said electronic circuit;

(c) a battery for supplying an electric power to said electronic circuit;

(d) an electronic optical display element driven by said electronic circuit;

(e) a connector for electrically connecting said electronic circuit to said electro-optical display element;

(f) a connector frame for mounting said connector thereon;

(g) a flexible printed circuit substrate for mounting said electronic parts included in said electronic circuit thereon;

(h) a supporting plate for covering said circuit substrate;

(i) a contact spring for constituting said switch mechanism;

(j) a base plate for mounting an interconnector thereon, said interconnector supplying the electrical power from said battery to said electronic circuit; and (k) a battery cavity formed in said base plate and enclosing said battery therein; said electro-optical display element, connector frame, supporting plate, circuit substrate and base plate being suitably combined together into one integral body.

2. The electronic timepiece according to claim 1, wherein between said supporting plate and said base plate is firmly sandwiched said circuit substrate.

3. The electronic timepiece according to claim 1, wherein said base plate is used also as a back cover of said timepiece.

4. The electronic timepiece according to claim 1, wherein said battery is detachably inserted through the side surface of said battery cavity thereinto.

5. The electronic timepiece according to claim 1, wherein said electro-optical display element is composed of two upper and lower transparent substrates which are the same in configuration and provided at the end and side surfaces thereof with outside connection electrodes, respectively.

6. The electronic timepiece according to claim 1, wherein said electronic circuit is electrically connected through an electrically conductive member provided at the side surface of said electro-optical display element to said electro-optical display element.

7. The electronic timepiece according to claim 1, wherein said electro-optical display element is bonded with a cover glass of a timepiece case and made integral therewith.

8. The electronic timepiece according to claim 1, wherein said supporting plate is provided at its one portion with at least one spring member for constituting said switch mechanism.

9. The electronic timepiece according to claim 1, wherein said supporting plate is electrically connected at its anode to ground.

10. The electronic timepiece according to claim 1, wherein said electro-optical display element is bonded with a cover glass separated from a timepiece case and made integral with said cover glass, to form an integrated constitutional member, said integrated constitutional member being mounted on said connector frame, said connector frame together with any other constitutional members being mounted on said timepiece case.

* * * * *